US005534882A

United States Patent [19]

Lopez

[11] Patent Number: 5,534,882

[45] Date of Patent: Jul. 9, 1996

[54] GPS ANTENNA SYSTEMS

[75] Inventor: Alfred R. Lopez, Commack, N.Y.

[73] Assignee: Hazeltine Corporation, Greenlawn, N.Y.

[21] Appl. No.: 191,562

[22] Filed: Feb. 3, 1994

[51] Int. Cl.[6] ..... H01Q 1/12

[52] U.S. Cl. ..... 343/891; 343/798; 343/813; 343/853

[58] Field of Search ..... 343/797, 798, 343/799, 800, 890, 891, 812, 813, 853; H01Q 1/12

[56] References Cited

U.S. PATENT DOCUMENTS

| | | | |
|---|---|---|---|
| 2,255,520 | 9/1941 | Schuster | 343/890 X |
| 2,589,433 | 3/1952 | Riblet | 343/771 X |
| 2,881,436 | 4/1959 | Stavis | 343/771 X |
| 3,085,204 | 4/1963 | Sletten | 343/799 X |
| 3,329,959 | 7/1967 | Laub et al. | 343/890 X |
| 3,510,876 | 5/1970 | Green et al. | 343/798 |
| 3,587,110 | 6/1971 | Woodward | 343/813 |
| 3,829,864 | 8/1974 | Truskanov et al. | 343/890 X |
| 4,083,051 | 4/1978 | Woodward | 343/798 X |
| 4,180,820 | 12/1979 | Johns | 343/890 X |
| 4,315,264 | 2/1982 | DuHamel | 343/798 X |
| 4,317,122 | 2/1982 | Ben-Dov | 343/890 X |
| 4,641,146 | 2/1987 | Gehman | 343/814 |
| 4,823,144 | 4/1989 | Guy | 343/853 |
| 5,061,944 | 10/1991 | Powers et al. | 343/818 X |
| 5,243,354 | 9/1993 | Stern et al. | 343/853 X |

FOREIGN PATENT DOCUMENTS

| | | | |
|---|---|---|---|
| 2509695 | 6/1975 | Germany | 343/890 |

OTHER PUBLICATIONS

Jasik et al, *Antenna Engineering Handbook*, 1961 (no month), pp. 23–17–23–19.

*Primary Examiner*—Donald T. Hajec
*Assistant Examiner*—Steven Wigmore
*Attorney, Agent, or Firm*—E. A. Onders; K. P. Robinson

[57] ABSTRACT

Antenna systems particularly suited for reception of GPS satellite signals include a vertical stack of element arrays. Each array, which may comprise four dipoles positioned around a central axis, receives signals phased to produce a circularly polarized 360 degree progressive phase radiation pattern around the axis. By rotating in azimuth the radiation patterns of certain of the element arrays and controlling the amplitude of signals applied to different arrays in the stack of arrays, a circularly polarized radiation pattern can be provided encompassing the entire upper hemisphere above the horizon, with a sharp pattern cutoff at or slightly below the horizon. A seven array stack of individual arrays each including four angled dipoles, with a distribution network for providing signals of desired relative phase and relative amplitude to each of the 28 included dipoles, is described. GPS antenna systems can be provided in lightweight three inch diameter by 40 inch length cylindrical form, for example, for use in land surveying applications, as well as for use in aircraft approach and landing systems and other applications. For use on moving motor vehicles, antenna systems can be provided in a configuration about ten inches high including only three element arrays and having a reduced cutoff characteristic so as to accommodate antenna tilting during use.

25 Claims, 5 Drawing Sheets

GPS ANTENNA SYSTEMS

This invention relates to improved forms of antenna systems particularly adapted for receiving signals from Global Positioning System (GPS) satellites and, more generally, to antenna systems providing a circular polarization characteristic in all directions horizontally and upward from the horizon, with a sharp cut-off characteristic below the horizon.

BACKGROUND OF THE INVENTION

The GPS has evolved to the point where its accuracy and capabilities have been shown potentially to be adequate for aircraft landing operations, land surveying and other present and potential applications beyond basic navigational uses. However, in a number of such applications multipath error in reception of the GPS signals is the principal limitation in achieving the full accuracy potentially available in use of the GPS signals.

In GPS application for aircraft precision approach and landing guidance, for example, a key element is the use of Differential GPS (DGPS). As proposed for DGPS, a reference receiver station is located near an airport runway and, ideally, may service all runways at one airport and potentially several airports in a local sector. The function of the DGPS reference receiver is to provide corrections for ionospheric, tropospheric and satellite clock and ephemeris errors. The ground station would utilize an antenna with an accurately determined phase center to measure the local error in reception of the satellite transmissions. This error information, transmitted to an aircraft preparing to land, would permit on-board error correction. With full error correction, the accuracy inherent in the GPS signals can be more fully utilized.

Multipath error has been determined to be the principal limitation in achieving the degree of vertical accuracy required for aircraft approaches and landings under conditions of limited visibility. Multipath errors resulting from ground reflections are fundamental, however lateral multipath effects (as caused by buildings, for example) can also cause substantial errors. The ground multipath effects at the aircraft and at the ground reference point are both important considerations. With respect to the aircraft, there is little opportunity for improvement of the aircraft antenna characteristics to suppress multipath, because of the wide coverage required to enable signals to be received from at least four satellites and to accommodate aircraft roll and pitch. Aircraft motion does provide some benefit in averaging ground reflection errors, however the potential for significant error remains. Multipath errors in GPS application for aircraft approach and landing are considered in greater detail in the inventor's article entitled "GPS Autoland Considerations", in IEEE AES Systems Magazine, pages 37–39, April 1993.

A variety of forms of antennas have been considered for GPS applications. In addition, techniques such as use of corrugated ground planes, or location of the antenna on a circular ground plane positioned in close proximity to the ground, have been suggested in order to reduce ground reflections. However, these techniques do not fully solve the ground and lateral multipath problems. In addition, such non-elevated antennas have inherent disadvantages, such as the limited coverage area and the need for protection against flooding, dirt, debris and snow build-up, and protection against damage from airport traffic and ground maintenance activities.

It is therefore an object of this invention to provide antenna systems having a circular polarization characteristic (e.g., right circular polarization) at all directions horizontally and upward from a plane (e.g., from the horizon to the zenith) and having a sharp cut-off characteristic beginning at the horizon or at a limited angle below the horizon.

It is a further object to provide compact and economical GPS systems utilizing stacked arrays of dipoles.

It is an additional object to provide antenna systems having a circular polarization characteristic in all directions above a cut-off angle, which characteristic is effective to discriminate against reception of ground and lateral multipath signals which have undergone polarization reversal upon reflection. Further objects are to provide new and improved antenna systems usable for a variety of GPS and other applications.

SUMMARY OF THE INVENTION

In accordance with the invention, an antenna system, having a circular polarization characteristic horizontally and upward from a plane, includes a plurality of element arrays spaced along an axis normal to such plane and configured to operate with circular polarization. Each of the element arrays includes a plurality of radiating elements positioned around the axis. The antenna system also includes distribution means, coupled to the element arrays, comprising the following. Transmission line means are arranged for distributing signals. First coupling means, coupled to the transmission line means, are arranged for coupling to the respective radiating elements of a first element array, of the plurality of element arrays, first signals of relative phase effective to produce a first radiation pattern having a 360 degree progressive phase characteristic around the axis, such first signals having a first average amplitude. A plurality of additional coupling means are arranged for coupling to the respective radiating elements, of the remaining element arrays, additional signals of relative phase effective to produce respective additional radiation patterns each having a 360 degree progressive phase characteristic around the axis, with at least one of the additional radiation patterns rotated in azimuth by a predetermined angle relative to the first radiation pattern. The additional signals coupled to at least one of the remaining element arrays are arranged to have an average amplitude differing from the first average amplitude of the signals coupled to the first element array. The distribution means further comprises means for supporting the antenna system above such plane.

Also in accordance with the invention, an antenna system for receiving GPS satellite signals is arranged to provide a first circular polarization characteristic horizontally and upward from a plane and includes at least five element arrays each including four dipoles positioned around an axis normal to such plane with the arm portions of each dipole tilted relative to the plane. The element arrays are numbered and spaced along the axis successively further from such plane as follows 5, 3, 1, 2 and 4. The antenna system also includes distribution means, coupled to the element arrays, comprising the following. Four transmission lines are arranged for distributing signals effective to cause the four dipoles of each element array to have a relative phase relationship of zero, 90, 180 and 270 degrees. Coupling means are provided for coupling each of the four transmission lines to a different single dipole of each of the five element arrays. Feed means, coupled to the four transmission lines, divide input signals into four signal portions having relative phases which are integral multiples of 90 degrees and couple each of the four signal portions to a different one of the four transmission lines. More particularly, the distribution means are configured to provide signals having a relative phase relationship, as coupled to the dipoles of element array No. 1, effective to produce a first radiation pattern having a 360 degree progressive phase characteristic and signals as coupled to the dipoles of the remaining element arrays effective to produce similar radiation patterns which are rotated in azimuth relative to such first radiation pattern, as follows; element arrays Nos. 2 and 4, negative 90 degrees rotation; element arrays Nos. 3 and 5, positive 90 degrees rotation. In addition, the four transmission lines are arranged to cause signals coupled to the dipoles of the element arrays to have approximately the following relative average amplitudes: element array No. 1, one-half $\pi$ amplitude; element arrays Nos. 2 and 3, unity amplitude; element arrays Nos. 4 and 5, one-third amplitude. The abbreviations No. and Nos. are sometimes used for the words number and numbers.

For a better understanding of the invention, together with other and further objects, reference is made to the following description taken in conjunction with the accompanying drawings and the scope of the invention will be pointed out in the accompanying claims.

It should be noted that the figures are not necessarily to scale, since particular features have been emphasized for clarity of description and understanding.

DESCRIPTION OF THE INVENTION

Figure 1A:
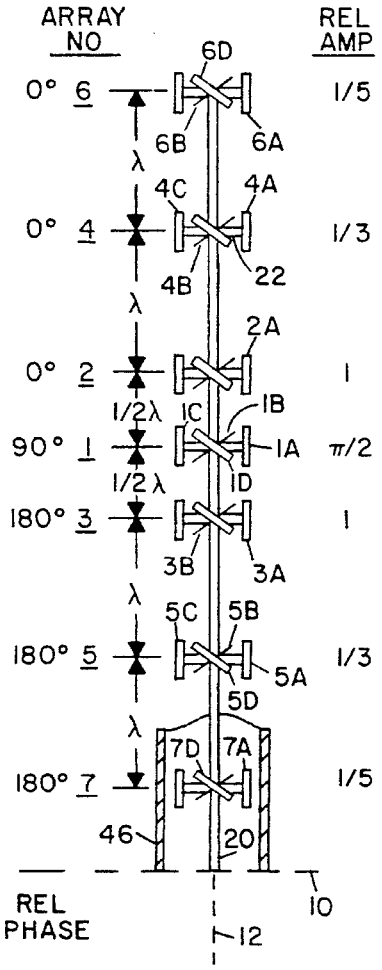
FIGS. 1*a* and 1*b* show an antenna system in accordance with the invention which includes a spaced vertical stack of seven arrays each including four dipoles.
Figure 2A:
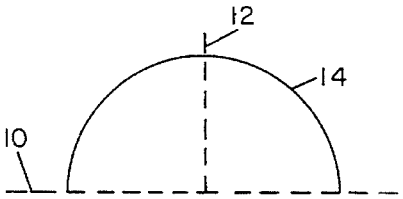
FIGS. 2*a* and 2*b* are conceptual diagrams illustrating hemispherical circularly polarized radiation pattern coverage.
Figure 2B:
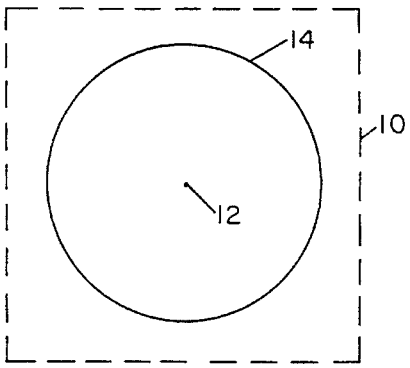

FIG. 1*a* illustrates an embodiment of an antenna system utilizing the invention in order to provide a first circular polarization characteristic (e.g., right circular polarization) horizontally and upward from a plane. This characteristic is figuratively illustrated in FIGS. 2*a* and 2*b* on an ideal basis which, in practice, will be approximated. In FIG. 2*a*, a horizontal plane is represented in side view by dotted line 10 and a central axis 12 is shown normal to plane 10. The polarization characteristic is represented by circular line portion 14 showing an antenna radiation pattern which extends equally at all elevations upward to the zenith. In FIG. 2*a* the antenna pattern is also shown as having a sharp cutoff at plane 10 for enhanced multipath signal discrimination, as will be further discussed. This antenna pattern is also illustrated by the computer-generated pattern data shown in FIG. 10. FIG. 2*b* shows a plan view of omnidirective antenna pattern 14 centered about axis 12 on a portion of plane 10. Plane 10 represents a horizontal stratum for reference purposes, and does not represent any physical antenna element or reflective surface.

Figure 1B:
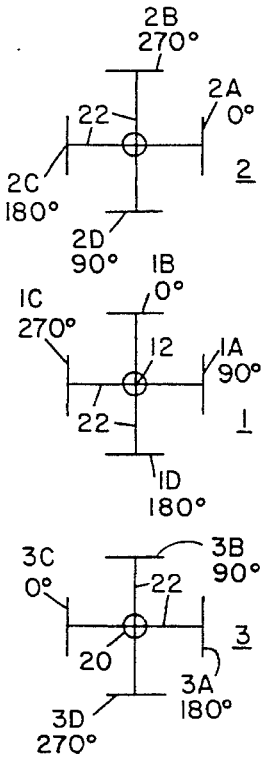

Referring to the FIG. 1*a* antenna system, a mast 20 supporting the antenna system is shown centered on axis 12 which is normal to the horizontal plane represented at 10. As illustrated, the antenna system includes a plurality of element arrays, shown as dipole arrays 1–7, spaced along mast 20, and thereby spaced along axis 12. Considering element array 1, it consists of four dipoles each supported by coupling means illustrated as a base portion (such as shown at 22 with respect to dipole 1A) extending from mast 20 so as to be positioned around axis 12. As shown for dipole 1D, each dipole is tilted so that its arm portions are at an angle of approximately 45 degrees to plane 10. For purposes of this description and appended claims, "approximately" is defined as encompassing a range of plus or minus 20 percent about a stated value, so that specific values may be specified in view of particular design considerations, test adjustments, etc., in specific applications. In FIG. 1*a* dipole 1D is in the front (permitting its tilted orientation to be seen), side dipoles 1A and 1C are seen in side profile and rear dipole 1B is shown in simplified form as a tilted line (to distinguish it from front dipole 1D). The A, B, C, D dipole labeling is typical for each of the other dipole arrays 2–7. The FIG. 1*a* antenna system looks the same when viewed from the front, the back, or either side. Thus, except for the specific dipole labels as shown, FIG. 1*a* may be considered a front, back or side view. FIG. 1*b* shows simplified top views of dipole arrays 1, 2 and 3 of the FIG. 1*a* antenna, illustrating the symmetrical character of the four dipoles of each array, with each dipole supported by a base portion 22 from mast 20. As shown, the four dipoles of each array are equally spaced around the mast 20 at 90 degree angular increments. The specific angular notations in FIG. 1*b* will be discussed below.

The FIG. 1*a* antenna system also includes distribution means coupled to the element arrays. The distribution means, which in this embodiment include transmission lines extending vertically, coupling means already referred to in the context of base portions 22, and feed means for coupling input signals, (the latter not being visible in the FIG. 1*a* view). Certain portions of the distribution means which are not visible in the FIG. 1*a* illustration will be here described as to form and function, with specific examples of physical embodiments left for discussion with reference to FIGS. 3 and 4. It should be noted that whereas for ease and clarity of description elements of the antenna system are generally described in the context of transmission or radiation of signals, a primary application of the antenna is in the reception of signals, to which the description is directly applicable in view of the well known principles of operation of antennas on a reciprocal basis.

Figure 3:
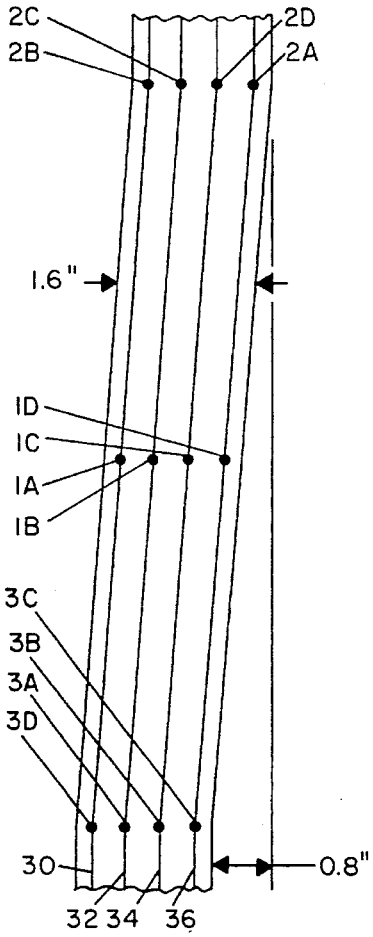
FIG. 3 shows one form of a four transmission line arrangement suitable for use in antenna systems in accordance with the invention.

Considering now the transmission line means for distributing signals, as included in the distribution means of the FIG. 1*a* antenna, FIG. 3 illustrates the portions of four transmission lines 30, 32, 34 and 36 which are arranged to serve dipole arrays 1, 2 and 3 of FIG. 1*a* in a particular embodiment. As shown in FIG. 3, the transmission line means includes the four transmission lines 30, 32, 34 and 36, each of which is arranged for feeding one predetermined dipole of each of the dipole arrays 1, 2 and 3 (and by extension is also arranged to feed one dipole in each of arrays 4, 5, 6 and 7). Consider transmission line 30 which, as shown, includes connection points 1A, 2B and 3D labeled to correspond to the individual dipoles in arrays 1, 2 and 3 which are fed from these connection points. With reference to FIG. 1*a*, it will be seen that in the antenna system as shown, the lettered dipoles of arrays 2 and 3 are in vertical alignment with the correspondingly lettered dipoles of array 1 (e.g., dipole 2A is directly above, and dipole 3A is directly below, dipole 1A in FIG. 1*a*). In FIG. 3 the central portions of lines 30, 32, 34 and 36 are inclined so that, when the FIG. 3 structure is curved laterally to form a cylinder, the transmission line 30 (which may be a conductive line on a thin printed circuit substrate) extends both upward and laterally. In this way, if the transmission line length is one-half wavelength at the signal frequency (180 degrees in phase) between points 1A and 2B in FIG. 3, a signal at point 2A (vertically above point 1A in the cylindrical form) will differ in phase by 90 degrees relative to the signal at point 1A, provided lines 30, 32, 34 and 36 are supplied with signals differing in phase by successive 90 degree increments. Thus, if the transmission line sections coupling the connection points shown in FIG. 3 were vertical, the half wavelength line lengths between the points would cause 180 degree phase differences between dipoles 1A and 2A, which are in vertical alignment in the FIG. 1*a* antenna system. However, since line 30, in the cylindrical form, progresses laterally one-quarter revolution between dipole arrays 1 and 2, the half wavelength line lengths between connection points cause only a 90 degree phase difference between dipole 1A and dipole 2A, which is directly above dipole 1A and FIG. 2*a*. The result, as illustrated in FIG. 1*b*, is that if dipoles 2A, 2D, 2C and 2B of array 2 receive reference phase signals effective to cause the four dipoles to have relative phasing of zero, 90, 180 and 270 degrees as shown, the correspondingly lettered dipoles 1A, 1D, 1C and 1B of array 1 will have relative phasing of 90, 180, 270 and zero degrees. Correspondingly, the dipoles 3A, 3D, 3C and 3B, of array 3 located below array 1, will have relative phasing of 180, 270, zero and 90 degrees. In FIG. 3 it will be seen that above points 2B, 2C, 2D and 2A, and below points 3D, 3A, 3B and 3C, the transmission lines 30, 32, 34 and 36 proceed vertically, without any lateral or angular progression. As a result, signals at points 4B, 4C, 4D and 4A (not shown in FIG. 3) will have the same respective phasing as the signals at points 2B, 2C, 2D and 2A, provided that the line lengths separating array 4 from array 2 and array 6 from array 4 are each equal to one full wavelength at the signal frequency (360 degrees in phase). Under similar conditions the signal phasing at arrays 5 and 7 will be the same as for array 3. These relationships are indicated in FIG. 1*b*, which shows the array 1, 2 and 3 relative signal phases, and it will be understood that the array 2 relative phasing applies also for arrays 4 and 6 and the array 3 relative phasing applies also for arrays 5 and 7. In overview, it will thus be seen that the signal phasing at arrays 2 and 3 have respectively been rotated forward and backward by 90 degrees relative to the array 1 signal phasing.

As stated above, the distribution means of the FIG. 1*a* antenna system also includes coupling means already referred to in the context of base portions 22. As shown in FIG. 1*a*, a similar dipole base portion 22 (represented more clearly in FIG. 1*b*), is associated with each dipole of each of arrays 1–7, and is arranged to support each dipole with a physical spacing of approximately one-eighth wavelength from axis 12 in a typical configuration. As will be further described, base portions 22 are arranged to each have an electrical length of approximately one-quarter wavelength by use of meander line sections. "First coupling means" are designated as the four dipole base portions 22 respectively coupling dipoles 1A, 1B, 1C and 1D to transmission lines 30, 32, 34 and 36, via respective coupling points 1A, 1B, 1C and 1D of FIG. 3. With the four transmission lines 30, 32, 34 and 36 and respective connection points as described with reference to FIG. 3, and the arrangement of arrays of dipoles as described with reference to FIG. 1*a*, the four base portions 22 comprising the first coupling means are effective for coupling to the respective dipole radiating elements of the first element array (element array 1) first signals of relative phase effective to produce a first radiation pattern having a 360 degree progressive phase characteristic around axis 12. Considering only array 1, with four 45 degree angled dipoles positioned symmetrically around mast 20 and supplied with signals as described, array 1 will be effective to produce a right circular polarized radiation pattern around axis 12 which has a 360 degree phase progressive orientation as indicated by the relative phasing shown for dipoles 1A, 1B 1C and 1D in FIG. 1*b*. Similarly, second coupling means are designated as the four dipole base portions 22 respectively coupling dipoles 2A, 2B, 2C and 2D to transmission lines 30, 32, 34 and 36, via respective coupling points 2A, 2B, 2C and 2D of FIG. 3. As described, this arrangement is effective to couple to the dipoles of the second dipole array second signals of relative phase effective to produce a second radiation pattern around axis 12 similar to the first such pattern, but which is shifted in azimuth by a predetermined angle of 90 degrees in this example, relative to the first such radiation pattern. Similarly, third coupling means designated as the base portions 22 between the transmission lines 30, 32, 34 and 36 and dipoles 3A, 3B, 3C and 3D couple third signals of relative phase effective to produce a similar 360 degree third radiation pattern also shifted in azimuth relative to the first such pattern (i.e., shifted by negative 90 degrees). In accordance with the invention, additional arrays (e.g., some or all of arrays 4, 5, 6 and 7, plus additional similar arrays as suitable in particular applications) may be included and excited to provide appropriately aligned 360 degree circularly polarized radiation patterns.

Figure 8A:
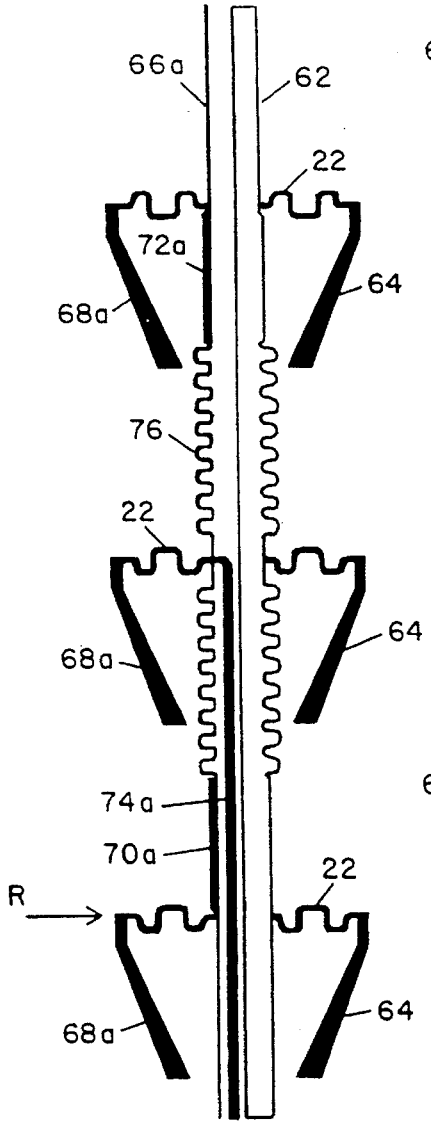
FIGS. 8*a* and 8*b* show a specific design configuration including dual spaced parallel transmission line/dipole configurations.
Figure 8B:
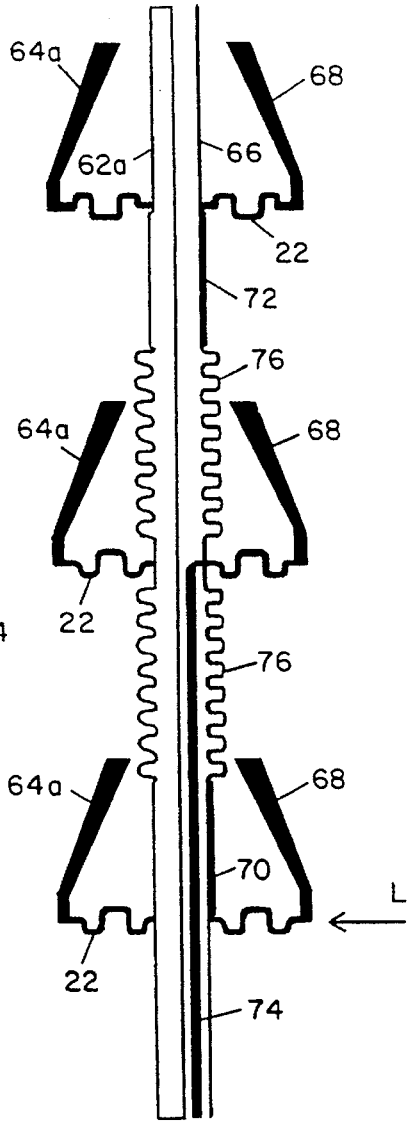
Figure 8C:
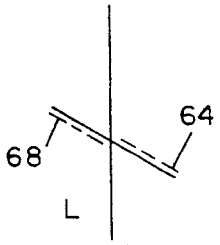
FIGS. 8*c* and 8*d* show left and right conceptual views useful in describing the configuration of FIGS. 8*a* and 8*b*.
Figure 8D:
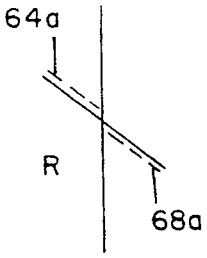

With reference to FIG 1*a*, it will be seen that element array 1 is positioned a first distance above plane 10, with arrays 2 and 3 respectively positioned a second distance above array 1 and a third distance below array 1. These second and third distances, which are each about one-third of the free space wavelength at an operating frequency in this example, are indicated as being equal to the equivalent length of transmission line to provide the desired one-half wavelength phase differential between successive dipoles connected along the transmission line. However, in other applications the physical spacing between dipole arrays may be closer or otherwise such as to require transmission line meander configurations in known manner (as illustrated in FIGS. 8*a* and 8*b*) in order to achieve intervening electrical line lengths compatible with element separations. As will be described further, the number of element arrays, the orientation of respective radiation patterns and the amplitude of signals provided to the respective element arrays are specified as appropriate to achieve the desired overall polarization, system antenna pattern and lower hemisphere cutoff characteristics.

Although not visible in FIG. 1*a*, the antenna system in the embodiment described also includes feed means for dividing input signals into four signal portions having relative phases which are integral multiples of 90 degrees and for coupling one of such signal portions to each of the transmission lines 30, 32, 34 and 36 of FIG. 3. The feed means can be arranged to provide the four signal portions with relative phases of zero, 90, 180 and 270 degrees for coupling to element arrays comprising four identical dipoles, in order to provide the desired zero, 90, 180 and 270 degree relative phasing of the respective dipoles of each array. Alternatively, the feed means can be arranged to provide the four signal portions with relative phases of zero, 90, zero and 90 degrees, provided one dipole of each diametrically opposed pair of dipoles in each element array is physically arranged with reversed polarity. This can be accomplished in the FIG. 1*a* embodiment by having the upwardly inclined arm of dipole 1B represent the "grounded" arm, while the downwardly inclined arm of diametrically opposed dipole 1D represents the "grounded" arm. With this arrangement, signals of 90 degree phase coupled to dipoles 1B and 1D are effective to cause these two dipoles to have relative phasing of 90 and 270 degrees, as a result of the phase reversal introduced by the switching or reversal of the phasing or polarity of one dipole relative to the other.

Figure 4:
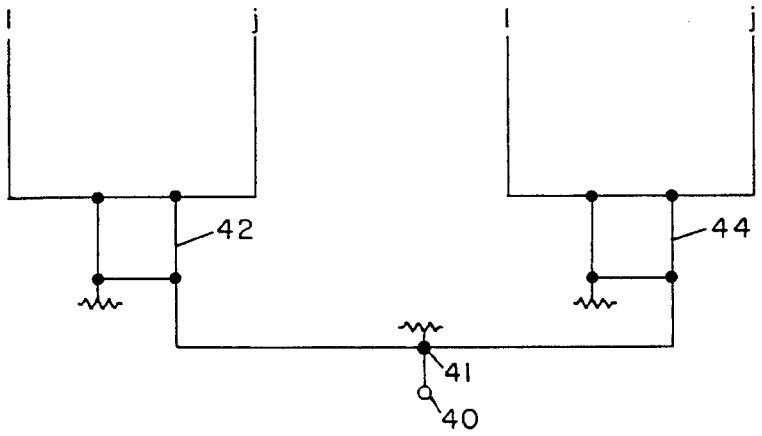
FIG. 4 shows a form of four-way power divider suitable for use in antenna systems in accordance with the invention.

FIG. 4 shows one form of the latter type of feed means in the form of a four-way power divider utilizing a two-way power divider 41 and two three dB quadrature couplers 42 and 44 to couple signals to the transmission lines 30, 32, 34 and 36. A 180 degree phase shift is achieved by switching arms of diametrically opposed dipoles, as discussed, in order to provide 1, j, −1 and −j dipole phasing representing the desired zero, 90, 180 and 270 degree dipole phasing. In operation, input signals fed to input terminal 40 are divided in half and coupled to quadrature couplers 42 and 44, or oppositely processed during reception.

An antenna system of the type shown in FIG. 1*a* may also typically include a cylindrical radome 46 (shown in partial sectional view in FIG. 1*a*) constructed of radiation transmissive material and proportioned to fit over and around the dipole arrays to provide physical and atmospheric protection for the antenna system.

OPERATION

Figure 5:
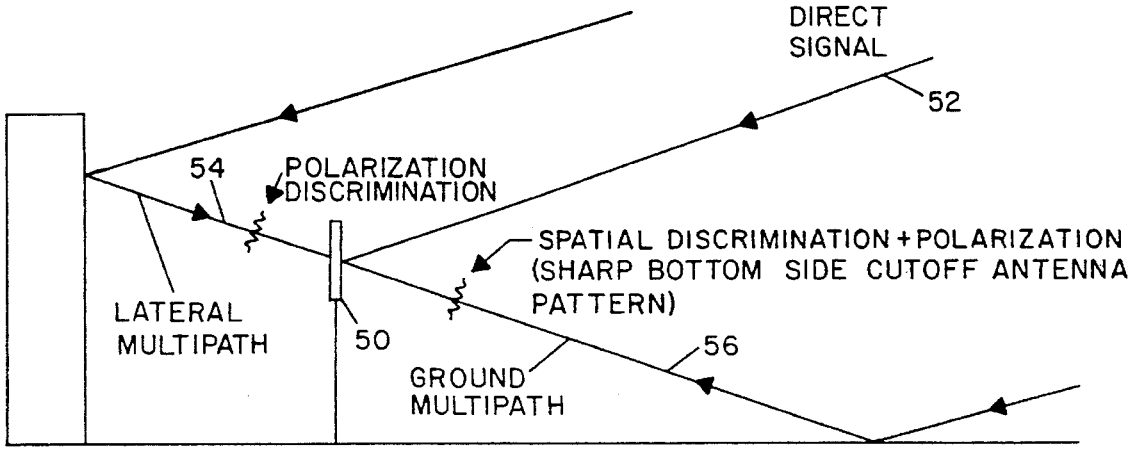
FIG. 5 is a conceptual drawing showing direct and multipath reflected signals in GPS operations.

In one implementation of an antenna system in accordance with the invention, for receiving signals from GPS satellites, a FIG. 1*a* type antenna system having an above-the-horizon right circular polarization characteristic in all directions horizontally and upward (e.g., as represented in FIGS. 2*a* and 2*b*) had the dimensions of a circular cylinder about three inches in diameter with a length of about 40 inches. Internally the antenna system included seven dipole arrays positioned along a metallic mast of about one-half inch diameter enclosing the transmission lines and four-way power divider. As represented in FIG. 5, this antenna system 50 was suitable for elevated, above-ground mounting so as to be isolated from typical conditions of flooding, snow accumulation or physical damage from ground activities. No corrugated or conductive ground plane structure is utilized.

As illustrated in FIG. 5, the design of the antenna system 50 is such as to provide a right circular polarization characteristic at all azimuths and elevations above the horizon, which provides the following characteristics.

(a) Excellent GPS satellite signal reception (see path 52 in FIG. 5) with right circular polarization along the horizon as well as in the zenith direction.

(b) Discrimination against lateral multipath reflections (54) from structures or other surfaces causing a polarization reversal to left circular polarization upon reflection.

(c) Discrimination against ground multipath reflections (56) based upon the sharp bottom side pattern cutoff provided by the invention, as well as polarization conversion on reflection.

(d) Forced excitation of array elements by use of interconnecting integral half wavelength length feed lines to reduce adverse effects from inter-element coupling of radiated signals.

(e) Point phase center characteristic provided by use of vertical line array antenna configuration with symmetrical excitation.

(f) Excellent radiation pattern gain profile by control of array spacing, array signal amplitudes and array signal phasing.

An ideal antenna for DGPS reference station usage for aircraft approach and landing use can be defined as having the following properties:

(1) Upper hemisphere coverage, 5 degrees to zenith.

(2) Suppression of reception of undesired signals, such as lateral and ground multipath reflections.

(3) Right circular polarization in all coverage directions.

(4) Point phase center.

(5) 2.5 dB higher gain near the horizon, relative to the zenith.

(6) Operating frequency of 1.57542 GHz.

(7) Bandwidth of 20 MHz.

Analysis has indicated that antenna systems utilizing the invention can be designed to closely satisfy all seven of the preceding ideal properties. In addition, the invention provides important benefits in other applications, such as GPS ground vehicle installations, ground surveying applications, etc.

FIGS. 6–10

With reference now to FIGS. 6–10, there are illustrated aspects of a printed conductive pattern form of implementation of the invention. Consideration of these figures will also permit discussion of transmission line design characteristics effective both (a) to determine the relative amplitudes of signals provided to the successive element arrays of an antenna system, and (b) to provide a forced-feed characteristic permitting signals to be coupled to dipoles substantially independently of intercoupling and other effects disruptive of the capability to actually radiate signals of desired phase and amplitude. Pattern shaping for positioning the sharp bottom-side cutoff somewhat below the horizon to provide further ground multipath discrimination is also encompassed.

Figures 6A, 6B, 6C, 7A, 7B:
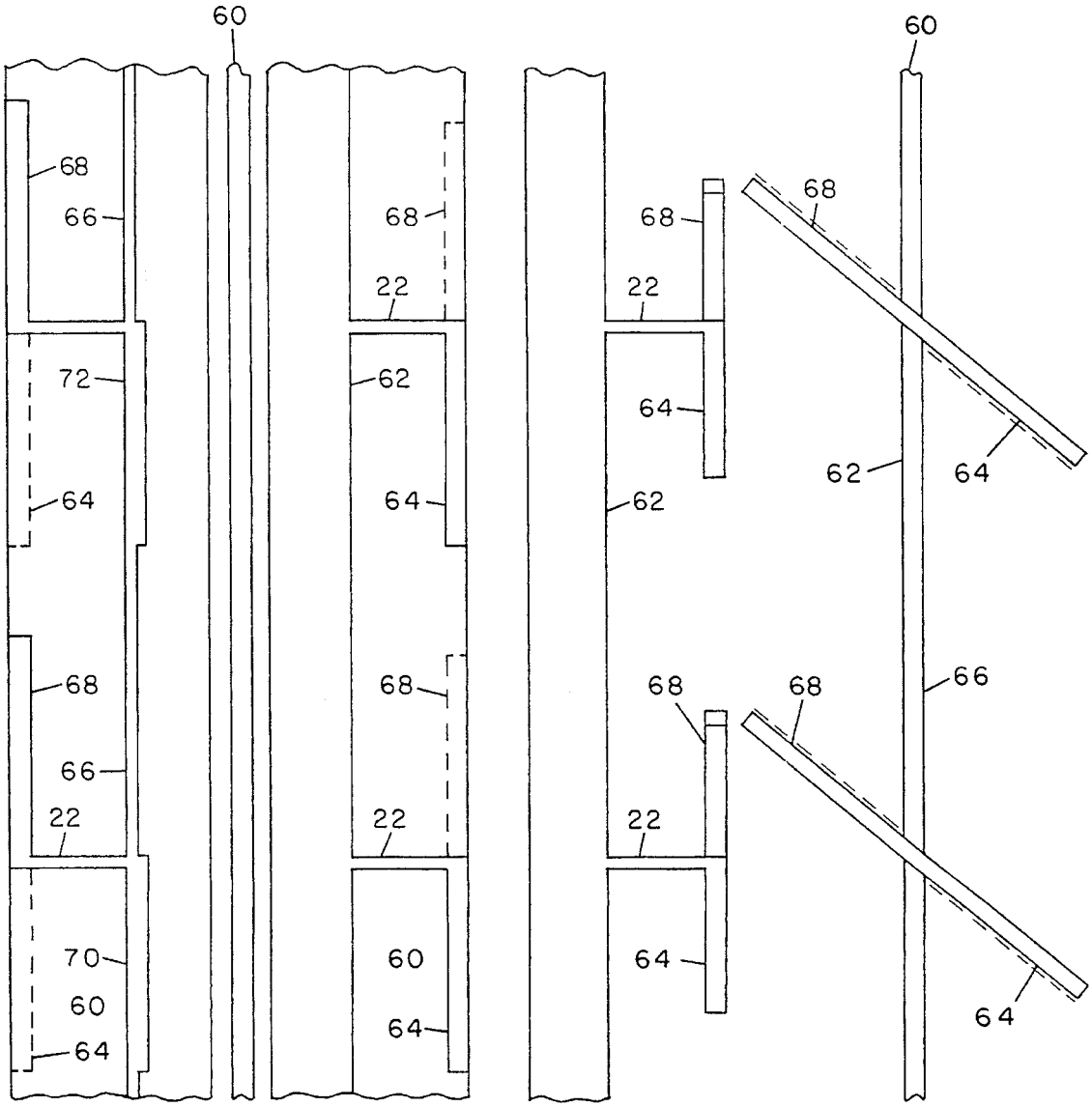
FIGS. 6*a*, 6*b* and 6*c* are left side, edge and right side views of a portion of one form of printed circuit signal distribution and dipole configuration in accordance with the invention.
FIGS. 7*a* and 7*b* are side and edge view of the FIG. 6 printed circuit configuration with portions of the substrate removed and the dipole arm portions rotated to angular positions.

FIGS. 6*a*, 6*b* and 6*c* show a form of implementation of two vertically successive dipoles formed as conductive patterns on a relatively thin printed circuit insulative substrate 60. FIG. 6*b* represents an edge view of the pattern bearing substrate 60. Side view FIG. 6*c* shows a transmission line ground plane section 62 connected, via base portions 22, to lower dipole arm portions 64 (e.g., the dipole arms which are to be inclined downwardly from dipole base portions 22 upon completion of assembly). Opposite side view FIG. 6*a* shows microstrip transmission line portion 66 connected to upper dipole arm sections 68 via base portions 22. In FIG. 6 the dipole arm sections on the opposite side of the substrate are shown dotted at 64 in FIG. 6*a* and 68 in FIG. 6*c*. Shown at 70 and 72 are microstrip transformer sections, which are line sections approximately one-quarter wavelength long whose impedances are determined by differences in pattern width so as to control the amplitude of signals coupled to the respective dipoles from the signals transmitted along the basic transmission line sections as indicated at 66. Microstrip design principles are well known and in this application the width of transformer sections 70 and 72 are adjusted to provide different desired average signal levels to each successive dipole connected along one of the transmission lines (e.g., line 30, 32, 34 or 36 in FIG. 3). With reference to FIG. 1*a*, the desired relative average signal voltage levels for each dipole of a particular array are as shown. Thus, in FIG. 1*a* the relative signal levels are indicated as ½ π, 1, 1, ⅓, ⅓, ⅕ and ⅕ for dipoles in arrays 1–7, respectively. These relative levels pertain separately for each of the four transmission lines for the successive predetermined dipoles connected along each respective line. It will be appreciated that while in the described embodiment each transmission line feeds signals to one predetermined dipole out of the four dipoles in each dipole array, in other embodiments other forms of signal distribution means using one or more transmission lines or other arrangements may be utilized. In the described embodiment the desired relative signal levels are achieved by specifying the appropriate line width microstrip transformer section for each successive dipole location upward from the base of the antenna system.

FIGS. 7*a* and 7*b* show side and front views of the dipole array section shown in FIGS. 6*a*, 6*b* and 6*c* after sections of the insulative substrate 60 which do not bear conductive patterns have been removed and the dipole arm sections have then been rotated so as to be positioned at an angle relative to a horizontal plane. Numerical references in FIGS. 7*a* and 7*b* correspond to those shown in FIGS. 6*a*, 6*b* and 6*c* and discussed with reference thereto. As previously discussed, an array of four such angled dipoles arranged around a central axis and appropriately excited are effective to provide a circularly polarized radiation pattern around the axis. Also, by stacking such dipole arrays and controlling relative signal levels, desired radiation pattern shaping and lower hemisphere cutoff can be achieved in accordance with the invention. After the dipoles are twisted to the angled positions as shown, appropriately shaped spacers, such as low-dielectric-constant foam wedges, may be put in place to retain the desired angular orientation in the assembled antenna system. FIGS. 7*a* and 7*b* show only two dipoles connected to one transmission line as an example of a portion of the FIG. 1*a* antenna system complement of 28 dipoles arranged in seven arrays along four transmission lines. As shown, each dipole includes respective conductive arm sections 64 and 68 adhered to opposite sides of the inclined portions of the substrate 60. The conductive pattern dipole arm portions 64 and 68 are represented as dotted lines in FIG. 7*b*.

FIG. 8*a* shows the upper surface of the upper side pattern of a conductive pattern including a ground plane 62 and associated dipole arms 64. The microstrip transmission line 66 and associated dipole arms 68, which are to be placed in operative cooperation with ground plane 62 are shown in FIG. 8*b*. FIG. 8*b* represents the upper surface of the lower side conductive pattern (e.g., the surface which is directly adhered to an insulative substrate, while the back surface of the FIG. 8*a* pattern is adhered to the same substrate, in registration). Correspondingly, ground plane 62*a* and associated dipole arms 64*a* in FIG. 8*a*, together with transmission line 66*a* and associated dipole arms 68*a*, provide a second series of dipoles 64*a*/68*a*, which are diametrically opposed to the 64/68 dipoles. It will thus be seen that when the FIG. 8*a* conductive pattern is placed directly over the FIG. 8*a* conductive pattern (without turning over or rotating either pattern) two parallel transmission line/ground plane configurations are formed with attached dipoles. Also, it will be seen that the 64/68 dipole arrangement generally resembles the similarly labeled configuration shown in FIGS. 7*a* and 7*b*. Referring now to the arrow labeled "L" in FIG. 8*b* and the L diagram in FIG. 8*c*, it will be appreciated that when the embodiment of FIGS. 8*a* and 8*b* is fully assembled for use and viewed in the direction of the L arrow, the 64/68 dipoles will have the dipole arm conductive pattern 68 inclined upwardly and the dipole arm conductive pattern 64 inclined downwardly, as illustrated in FIG. 7*b*. However, with reference to the arrow labeled "R" in FIG. 8*a* and the R diagram in FIG. 8*d*, it will be appreciated that in the assembled form, when viewed in the direction of the R arrow, the 64*a*/68*a* dipoles will have the transmission line connected and ground plane connected dipole arms respectively reversed relative to the 64/68 dipoles. The dipoles of these two diametrically opposed series of dipoles are thereby oppositely phased to provide a 180 phasing difference. As a result, if 90 degree relative phase signals were supplied to the lowest pair of 64/68 and 64*a*/68*a* dipoles shown in FIGS. 8*a* and 8*b*, one dipole would radiate a signal with a 90 degree phase, while the other dipole would radiate a signal with a 270 degree relative phase.

In the embodiment of FIGS. 8*a* and 8*b*, transmission line 66 is center fed by auxiliary transmission line 74. As shown, line 74 connects to line 66 at the middle dipole arm 68 of dipole 64/68 (which may be considered to correspond to dipole 1A of FIG. 1*a*) in order to feed signals from feed means, such as illustrated in FIG. 4. FIGS. 8*a* and 8*b* include the stepped impedance portions 70 and 72 which determine the relative voltage level of signals at each dipole. In FIGS. 8*a* and 8*b*, base portions 22 are provided as meander line sections in order to provide an electrical line length of approximately one-quarter wavelength (quarter-wave transformers) while providing a physical length of approximately one-eighth wavelength in free space. Similarly, transmission line 66 includes meander line sections 76 in order to provide an electrical line length between dipoles (e.g., between element arrays 1 and 2 in FIG. 1*a*) of approximately one wavelength, while providing a physical separation of approximately one-half of a free-space wavelength.

Figure 8E:
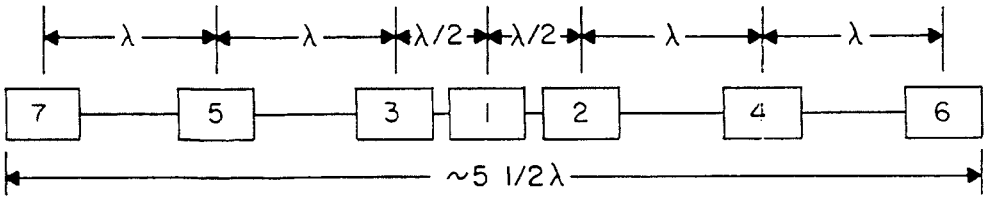
FIG. 8*e* is a block diagram of an antenna including seven stacked element arrays.

For operation at the GPS frequency of 1.57542 GHz, each dipole arm section such as 64 and 68 in FIGS. 8*a* and 8*b* is approximately 1.6 inches long and the dipoles are spaced along each transmission line with separations of about 3.5 inches. FIG. 8*e* is a block diagram of the complete antenna system of FIGS. 8*a* and 8*b* showing all seven of the dipole element arrays, with central array spacings of about 3.5 inches and other array spacings of about 7 inches, resulting in a total length of about 38.5 inches for the complete complement of arrays. As noted, for protection of the complete array structure it may be inserted into a cylindrical radome about 3 inches in diameter and 40 inches in length, as indicated at 46 in FIG. 1*a*.

Figures 9A, 9B, 9C:
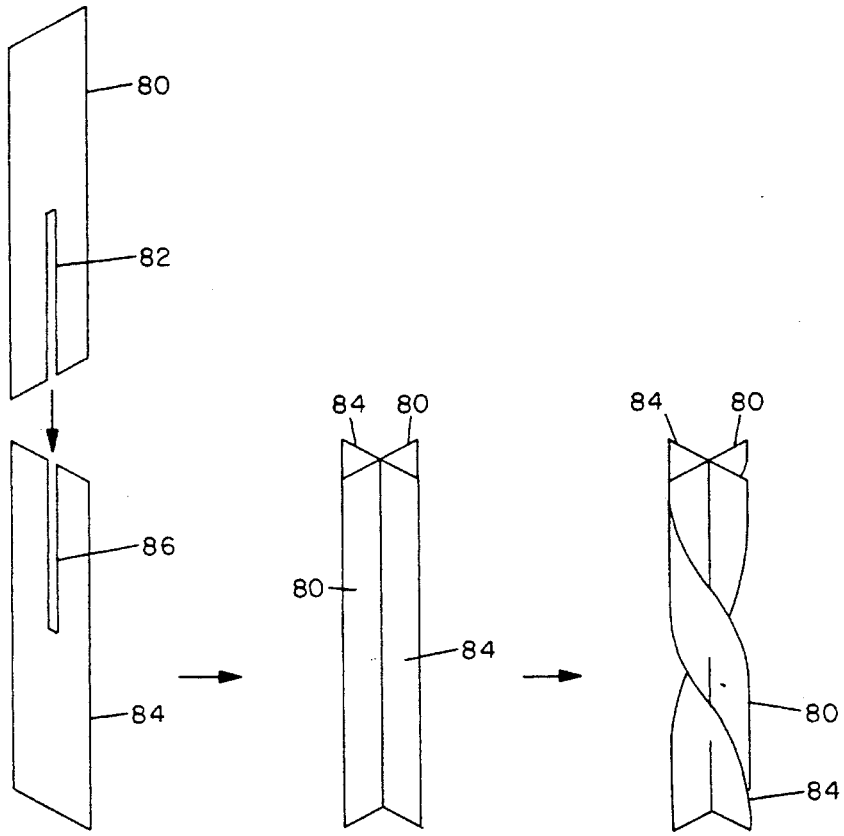
FIGS. 9*a*, 9*b* and 9*c* are conceptual drawings illustrating a mode of combining two FIGS. 8*a* and 8*b* type dual transmission line/dipole configurations to provide spaced four-dipole arrays in accordance with the invention.

FIG. 9 shows an array fabrication technique for introducing the desired azimuth rotation of the radiation patterns, while simultaneously providing the desired forced excitation of the radiating elements. The azimuth rotation of the central arrays 1, 2 and 3 is represented by the 90 degree phase differentials indicated in FIG. 1*b*. FIG. 9*a* is a simplified representation showing a first dual transmission line/dipole assembly 80 of the type shown in separated form in FIGS. 8*a* and 8*b*, which has been slotted at 82 from the bottom end upward between the two parallel transmission lines (i.e., between 62*a* and 74 in FIG. 8*a*). A second dual transmission line/dipole assembly 84 is identical to assembly 80, except that it has been slotted at 86 between the transmission lines from the top downward to a mid point. FIG. 9*b* shows assemblies 80 and 84 after sliding them together as indicated by the arrow in FIG. 9*a*, to form an interleaved configuration with arrays of four dipoles each spaced along the center axis as previously discussed. With dipole excitation this configuration would provide the desired 360 degree radiation patterns, but without the desired relative azimuth rotation of the three central arrays. FIG. 9*c* shows the FIG. 9*b* configuration after it has been physically twisted in the central region in order to provide the desired 90 degree radiation pattern azimuth shift between the dipole arrays 1, 2 and 3. With this approach, heat setting materials or foam or other positioning guides can be employed to maintain the desired twisted configuration illustrated schematically in FIG. 9*c*. In particular applications this or other production techniques can be employed by skilled workers once the invention is described.

Figure 10:
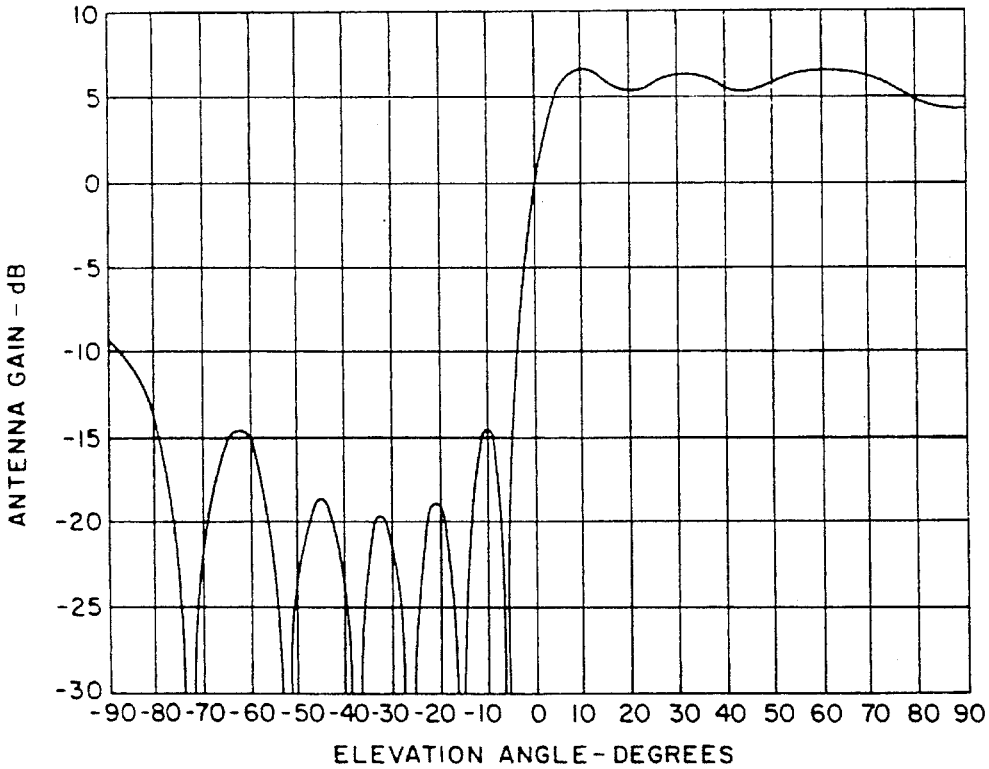
FIG. 10 is a computer generated antenna pattern illustrating substantially uniform antenna gain from horizon to zenith, with sharp pattern cutoff below the horizon.

FIG. 10 is a computer-generated plot of antenna gain versus elevation angle for an antenna system of the type illustrated in FIG. 1*a*. As shown, the gain is relatively uniform from the horizon to the zenith (0 to 90 degrees) with a sharp cutoff at the horizon (e.g., plane 10 in FIG. 1*a*). Below the horizon all sidelobes are indicated to be at least 10 dB down from the horizon to the nadir (0 to −90 degrees). In addition to the air traffic and landing applications as discussed, the invention may be usefully employed in many other applications utilizing the GPS system, or different satellite or other applications. In land surveying applications, the advantages of the invention are made possible in a sturdy, light-weight cylindrical package only about three inches in diameter and 40 inches in length. In providing GPS operation in a moving motor vehicle, the invention may be employed in a configuration only about three inches in diameter and ten inches high, by including only the central three element arrays of FIG. 1*a*. This configuration will be more amenable to possible tilting of the antenna during vehicle movement, as a result of the less-sharp cutoff characteristic of a three array antenna system.

There have been described both the invention and design and production techniques usable for implementation of the invention in dipole type antenna systems of the kind described. With the benefit of this information persons skilled in this field will be readily able to apply the invention employing other signal distribution arrangements, other forms of radiating elements, etc., as appropriate in different applications. Thus, while there have been described presently preferred embodiments of the invention, those skilled in the art will recognize that other and further modifications and variations may be made without departing from the invention. It is therefor intended to claim all such modifications and variations as fall within the scope of the invention.

What is claimed is:

1. An antenna system, having a first circular polarization characteristic horizontally and upward from a plane, comprising:

a plurality of element arrays spaced along an axis normal to said plane and configured to operate with circular polarization, each said element array including a plurality of radiating elements positioned around said axis, with said radiating elements of each array in vertical alignment with corresponding radiating elements in other arrays;

distribution means, coupled to said element arrays, including:

transmission line means for distributing signals;

first coupling means, coupled to said transmission line means, for coupling to the respective radiating elements of a first element array of said plurality of element arrays, first signals of relative phase effective to produce a first radiation pattern having a 360 degree progressive phase characteristic around said axis, said first signals having a first average amplitude;

a plurality of additional coupling means, coupled to said transmission line means, for coupling to the respective radiating elements of the remaining element arrays of said plurality of element arrays additional signals of relative phase effective to produce respective additional radiation patterns each having a 360 degree progressive phase characteristic around said axis with at least one of said additional radiation patterns rotated in azimuth phase by a predetermined angle relative to said first radiation pattern, said additional signals coupled to at least one of said remaining element arrays having an average amplitude differing from said first average amplitude; and means for supporting said antenna system above said plane.

2. An antenna system as in claim 1, wherein said transmission line means includes at least one transmission line to which one predetermined radiating element of each of said element arrays is coupled via said first and additional coupling means, said predetermined radiating elements thereby being coupled to said transmission line at points separated by transmission line portions of length approximately equal to integral multiples of one-half wavelength at a design frequency, as measured along said transmission line.

3. An antenna system as in claim 2, wherein said one transmission line includes sections of differing impedance arranged to determine the amplitude of said first signals and additional signals coupled respectively to said predetermined radiating elements of said first element array and said remaining element arrays, to cause signal amplitudes for radiating elements included in upper and lower elements arrays of said plurality of element arrays spaced along said axis to be lower than a signal amplitude for a radiating element included in an element array positioned along said axis between said upper and lower element arrays.

4. An antenna system as in claim 1, wherein said distribution means are configured so that said predetermined angle of radiation pattern azimuth phase rotation of the respective radiation pattern of each of said remaining element arrays, relative to said first radiation pattern, is an integral multiple of 90 degrees.

5. An antenna system as in claim 1, wherein said radiating elements are dipoles having arm portions positioned at an angle between 40 and 50 degrees, relative to said plane.

6. An antenna system, having a first circular polarization characteristic horizontally and upward from a plane, comprising:

first, second and third element arrays for radiating circularly polarized signals, each said element array including a plurality of radiating elements positioned around an axis normal to said plane, with said radiating elements of each array in vertical alignment with corresponding radiating elements in other arrays said first element array positioned a first distance above said plane, said second element array positioned a second distance above said first element array and said third element array positioned a third distance below said first element array;

distribution means, coupled to said element arrays, including:

transmission line means for distributing signals;

first coupling means coupled to said transmission line means for coupling, to the respective radiating elements of said first element array, first signals of relative phase effective to produce a first radiation pattern having a 360 degree progressive phase characteristic, said first signals having a first average amplitude;

second coupling means coupled to said transmission line means for coupling, to the respective radiating elements of said second element array, second signals of relative phase effective to produce a second radiation pattern having a 360 degree progressive phase characteristic which is shifted in azimuth phase by a predetermined angle relative to said first radiation pattern, said second signals having a second average amplitude;

third coupling means coupled to said transmission line means for coupling, to the respective radiating elements of said third element array, third signals of relative phase effective to produce a third radiation pattern having a 360 degree progressive phase characteristic which is shifted in azimuth phase by a predetermined angle relative to said first radiation pattern, said third signals having a third average amplitude; and means for supporting said first, second and third element arrays above said plane;

said antenna system being configured for receiving satellite signals.

7. An antenna system as in claim 6, wherein said transmission line means includes at least one transmission line to which one predetermined radiating element of each of said first, second and third element arrays is coupled via said first, second and third coupling means respectively, said predetermined radiating elements thereby being coupled to said transmission line at points separated by transmission line portions of length approximately equal to integral multiples of one-half wavelength at a design frequency, as measured along said transmission line.

8. An antenna system as in claim 7, wherein said one transmission line includes sections of differing impedance arranged to determine said first, second and third average amplitudes of said signals respectively coupled to said predetermined radiating elements of said first, second and third element arrays, to cause signal amplitudes coupled to said predetermined radiating element of said first element array to be larger than signal amplitudes coupled to said predetermined radiating elements of said second and third element arrays.

9. An antenna system as in claim 6, wherein said transmission line means comprises four transmission lines, each arranged for feeding one predetermined radiating element of each of said first, second and third element arrays, and said distribution means additionally includes feed means, coupled to said four transmission lines, for dividing input signals into four signal portions having relative phases which are integral multiples of 90 degrees and for coupling one of said signal portions to each of said transmission lines.

10. An antenna system as in claim 6, wherein said distribution means are arranged to cause said predetermined angles of radiation pattern azimuth phase shift associated with said second and third element arrays to each be within ten degrees of 90 degrees, in opposite directions.

11. An antenna system as in claim 6, wherein said third distance differs from said second distance by less than ten percent of said second distance and said second and third average amplitudes are approximately two thirds of said first average amplitude.

12. An antenna system as in claim 6, additionally comprising:

fourth and fifth element arrays, similar to said first, second and third element arrays, said fourth and fifth element arrays respectively positioned a predetermined distance above said second element array and a predetermined distance below said third element array; and fourth and fifth coupling means, similar to said first, second and third coupling means, for coupling signals of predetermined amplitude and phase to respectively cause said fourth element array to produce a fourth radiation pattern having a 360 degree progressive phase characteristic in azimuth alignment with said second radiation pattern and said fifth element array to produce a fifth radiation pattern having a 360 degree progressive phase characteristic in azimuth alignment with said third radiation pattern.

13. An antenna system as in claim 12, additionally comprising:

sixth and seventh element arrays, similar to said first, second and third element arrays, said sixth and seventh element arrays respectively positioned a predetermined distance above said fourth array and a predetermined distance below said fifth element array; and sixth and seventh coupling means, similar to said first, second and third coupling means, for coupling signals of predetermined amplitude and phase to respectively cause said sixth element array to produce a sixth radiation pattern having a 360 degree progressive phase characteristic in azimuth alignment with said second radiation pattern and said seventh element array to produce a seventh radiation pattern having a 360 degree progressive phase characteristic in azimuth alignment with said third radiation pattern.

14. An antenna system as in claim 6, wherein said first, second and third element arrays each comprise four dipoles symmetrically positioned around said axis, with the arm portions of each dipole aligned at an angle to said plane.

15. An antenna system as in claim 14, wherein said means for supporting includes a central mast encompassing said axis and said first, second and third coupling means are arranged to support each of said dipoles, of said first, second and third array means, with a spacing from said axis equal to approximately one-eighth wavelength at a design frequency.

16. An antenna system as in claim 6, wherein said first, second and third element arrays each comprise four radiating elements symmetrically positioned around said axis and said transmission line means comprises four transmission lines, each arranged for feeding one predetermined radiating element of each of said first, second and third element arrays.

17. An antenna system as in claim 16, wherein said second and third coupling means are each coupled to said four transmission lines at points which are separated from points at which said first coupling means are coupled to said transmission lines by sections of the respective transmission lines having lengths approximating an integral multiple of one-half wavelength at a design frequency.

18. An antenna system as in claim 16, wherein each of said four transmission lines includes sections of different characteristic impedance selected to determine said first, second and third average amplitudes of said signals coupled to said first, second and third element arrays.

19. An antenna system as in claim 16, wherein said distribution means additionally includes feed means, coupled to said four transmission lines, for dividing input signals into four signal portions having relative phases of zero, 90, 180 and 270 degrees and for coupling one of said signal portions to each of said transmission lines.

20. An antenna system as in claim 19, wherein said feed means includes a four-way power divider.

21. An antenna system for receiving GPS satellite signals, said antenna system having a first circular polarization characteristic horizontally and upward from a plane, comprising:

at least five element arrays each including four dipoles positioned around an axis normal to said plane with the arm portions of each dipole tilted relative to said plane, said four dipoles of each array in vertical alignment with corresponding dipoles in other arrays, with said element arrays numbered and spaced along said axis successively further from said plane as follows 5, 3, 1, 2and 4;

distribution means, coupled to said element arrays, including:

four transmission lines for distributing signals effective to cause the four dipoles of each said element array to have relative phasing of zero, 90, 180 and 270 degrees;

coupling means for coupling each of said four transmission lines to a different single dipole of each of said five element arrays; and feed means, coupled to said four transmission lines, for dividing input signals into four signal portions having relative phases which are integral multiples of 90 degrees and for coupling each of said four signal portions to a different one of said four transmission lines;

said distribution means configured to provide said signals having said relative phase relationship as coupled to the dipoles of said element array No. 1 to produce a first radiation pattern having a 360 degree progressive phase characteristic and said signals as coupled to the dipoles of the remaining element arrays to produce similar radiation patterns which are rotated in azimuth phase relative to said first radiation pattern as follows: element arrays Nos. 2 and 4, negative 90 degrees phase rotation; element arrays Nos. 3 and 5, positive 90 degrees phase rotation.

22. An antenna system as in claim 21, wherein said four transmission lines each include sections of differing impedance arranged to cause signals coupled to the dipoles of said element arrays Nos. 2 and 3 to be of lower amplitude than signals coupled to the dipoles of said element array No. 1, and signals coupled to the dipoles of said element arrays Nos. 4 and 5 to be of lower amplitude than signals coupled to the dipoles of said element arrays Nos. 2 and 3.

23. An antenna system as in claim 21, wherein said four transmission lines each include sections of differing impedance arranged to cause signals coupled to the dipoles of said element arrays Nos. 2 and 3 to be of lower amplitude than signals coupled to the dipoles of said element array No. 1, and signals coupled to the dipoles of said element arrays Nos. 4 and 5 to be of lower amplitude than signals coupled to the dipoles of said element arrays Nos. 2 and 3.

24. An antenna system as in claim 21, wherein said four transmission lines are arranged to cause signals coupled to the dipoles of said element arrays to have approximately the following relative average amplitudes: element array No. 1, one-half $\pi$ amplitude; element arrays Nos. 2 and 3, unity amplitude; element arrays Nos. 4 and 5, one-third amplitude; element arrays Nos. 6 and 7, one-fifth amplitude.

25. An antenna system as in claim 21, wherein said dipoles of each said element array comprise two diametrically opposed pairs, with one dipole of each said pair polarized oppositely relative to the other dipole of said pair, and wherein said feed means provide a first two of said four signal portions with a first relative phase and the remaining two of said signal portions with a phase differing by 90 degrees relative to said first two signal portions.

* * * * *